US007163467B1

(12) United States Patent
Chang et al.

(10) Patent No.: US 7,163,467 B1
(45) Date of Patent: Jan. 16, 2007

(54) GOLF CLUB HEAD AND INSERTS

(76) Inventors: Dong Chang, 22488 E. Polk Dr., Aurora, CO (US) 80016; Michael Chang, 22488 E. Polk Dr., Aurora, CO (US) 80016; Brian Chang, 22488 E. Polk Dr., Aurora, CO (US) 80016

( * ) Notice: Subject to any disclaimer, the term of this patent is extended or adjusted under 35 U.S.C. 154(b) by 0 days.

(21) Appl. No.: 10/686,275

(22) Filed: Oct. 15, 2003

(51) Int. Cl.
*A63B 53/04* (2006.01)

(52) U.S. Cl. ..... 473/329; 473/342

(58) Field of Classification Search ..... 473/327, 473/330, 342
See application file for complete search history.

(56) References Cited

U.S. PATENT DOCUMENTS

| | | | | |
|---|---|---|---|---|
| 780,776 | A | 1/1905 | Brown | |
| 890,836 | A * | 6/1908 | Beale | 473/329 |
| 1,671,956 | A * | 5/1928 | Sime | 473/329 |
| 3,003,768 | A * | 10/1961 | Clements | 473/327 |
| 3,719,354 | A | 3/1973 | Evans et al. | |
| 4,869,508 | A | 9/1989 | Miller | |
| 5,000,455 | A | 3/1991 | Beilfuss, Sr. | |
| 5,054,784 | A | 10/1991 | Collins | |
| 5,316,304 | A * | 5/1994 | Yost | 473/330 |
| D353,176 | S | 12/1994 | Poggi | |
| 5,529,303 | A | 6/1996 | Chen | |
| 5,899,819 | A * | 5/1999 | Mount et al. | 473/329 |
| 5,944,614 | A | 8/1999 | Yoon | |
| D417,712 | S | 12/1999 | Antonious | |
| 6,027,414 | A * | 2/2000 | Koebler | 473/228 |
| 6,224,497 | B1 | 5/2001 | Antonious | |
| 6,431,997 | B1 | 8/2002 | Rohrer | |
| 6,517,450 | B1 * | 2/2003 | Klyve | 473/340 |
| 6,682,439 | B1 * | 1/2004 | Brown | 473/329 |
| 6,846,246 | B1 * | 1/2005 | Asplund et al. | 473/327 |

* cited by examiner

*Primary Examiner*—Eugene Kim
*Assistant Examiner*—Alvin A. Hunter, Jr.
(74) *Attorney, Agent, or Firm*—Ramon L. Pizarro; Edwin H. Crabtree

(57) ABSTRACT

A golf club head that includes several slotted apertures that extend through the body of the club head, the slotted apertures being defined by several generally parallel, spaced-apart elongated spring members, the spring members can be used to create a lower stiffness at their mid-section rather than their ends.

5 Claims, 3 Drawing Sheets

GOLF CLUB HEAD AND INSERTS

BACKGROUND OF THE INVENTION (a) Field of the Invention

This invention generally relates to a golf club head and various inserts for use with a golf club head. More particularly, but not by way of limitation, to a vented golf club face or faceplate that allows air to pass through the club head as the club is swung, and provides a sweet spot on the club head.

(b) Discussion of Known Art

The game of golf has gained a reputation as being a sport that is very difficult to master. The difficulty of mastering the game of golf involves control of golf swing, the mastering of a proper grip of the golf club, and the mastering of the player's stance prior to and during the swing.

An important aspect of the golf swing is the achievement of the needed speed of club head in order to gather kinetic energy and that will be transferred to the golf ball. Then, an important characteristic of the golf club, which is the club's ability to transfer of the club's kinetic energy to the ball, will come into play.

A known approach at enhancing the speed of the club head has been to incorporate horizontal or vertical slots into the club head in order to reduce the aerodynamic drag or aerodynamic forces on the club head. Examples of this approach can be found in U.S. Pat. No. 5,944,614 to Yoon, and U.S. Pat. No. 780,776 to Brown. A drawback to known designs that use slots to reduce drag is that the slotted structure can impart undesired spin or direction on the golf ball.

Accordingly, there remains a need for a golf club or golf club head that can provide the aerodynamic benefits of a slotted club head design, without the problems associated with undesired spin.

There remains a need for a slotted club head that provides highly predictable and efficient transfer of kinetic energy to the golf ball.

SUMMARY

It has been discovered that the problems left unanswered by known art can be solved by providing a golf club head that is mountable on a golf club shaft, the golf club head includes:

a body having a face with a planar surface, the face having several slotted apertures that extend through the body of the club head, the slotted apertures being defined by several generally parallel, spaced-apart elongated spring members, the spring members having a lower stiffness at their mid-section rather than their ends.

It will be understood that the spring members create a "sweet spot" at the area of lower stiffness. Additionally, it is contemplated that the spring members may be selectively connected to one another in order to further tailor the shape of the resulting sweet spot. Thus, in an example of the disclosed invention, several of the spring members are joined to one another in order to couple the members and control the resulting stiffness and direction of flex of the spring members.

Still further, in a disclosed example of the invention, the spring members are part of an insert that is accepted in an aperture through the club head. The use of an insert will allow manufacturers to vary inserts with the club head. For example, a three iron club-head may be fitted with inserts of different stiffness, and thus allow the manufacturer to produce three irons having different characteristics, depending on the insert used. It is also important to note that it is contemplated that the insert may be permanently fixed to the club head by the manufacturer or may be used as part of a system that allows the player to change the insert, allowing the player to change the characteristics of the club to better suit his needs.

It should also be understood that while the above and other advantages and results of the present invention will become apparent to those skilled in the art from the following detailed description and accompanying drawings, showing the contemplated novel construction, combinations and elements as herein described, and more particularly defined by the appended claims, it should be clearly understood that changes in the precise embodiments of the herein disclosed invention are meant to be included within the scope of the claims, except insofar as they may be precluded by the prior art.

DRAWINGS

The accompanying drawings illustrate preferred embodiments of the present invention according to the best mode presently devised for making and using the instant invention, and in which.

DETAILED DESCRIPTION OF PREFERRED EXEMPLAR EMBODIMENTS

While the invention will be described and disclosed here in connection with certain preferred embodiments, the description is not intended to limit the invention to the specific embodiments shown and described here, but rather the invention is intended to cover all alternative embodiments and modifications that fall within the spirit and scope of the invention as defined by the claims included herein as well as any equivalents of the disclosed and claimed invention.

Figure 1:
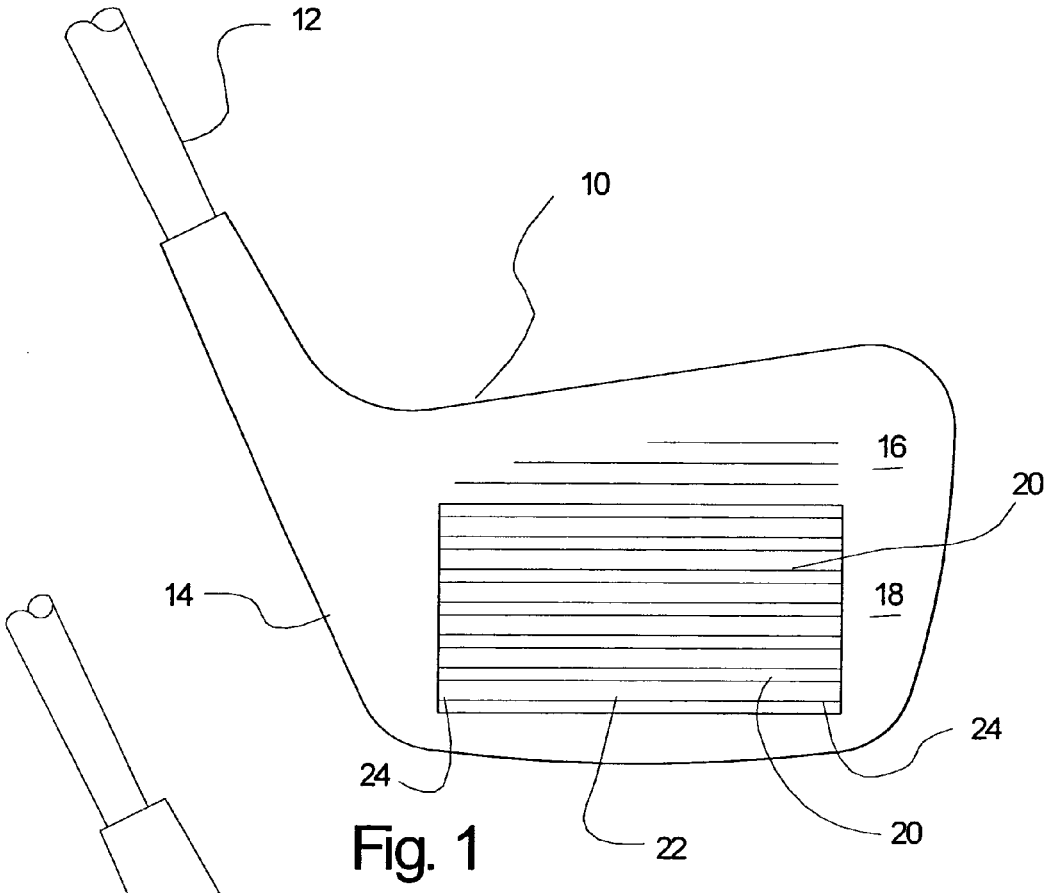
FIG. 1 is a view of an embodiment of the invention used on a "wood" or "iron" club.
Figure 2:
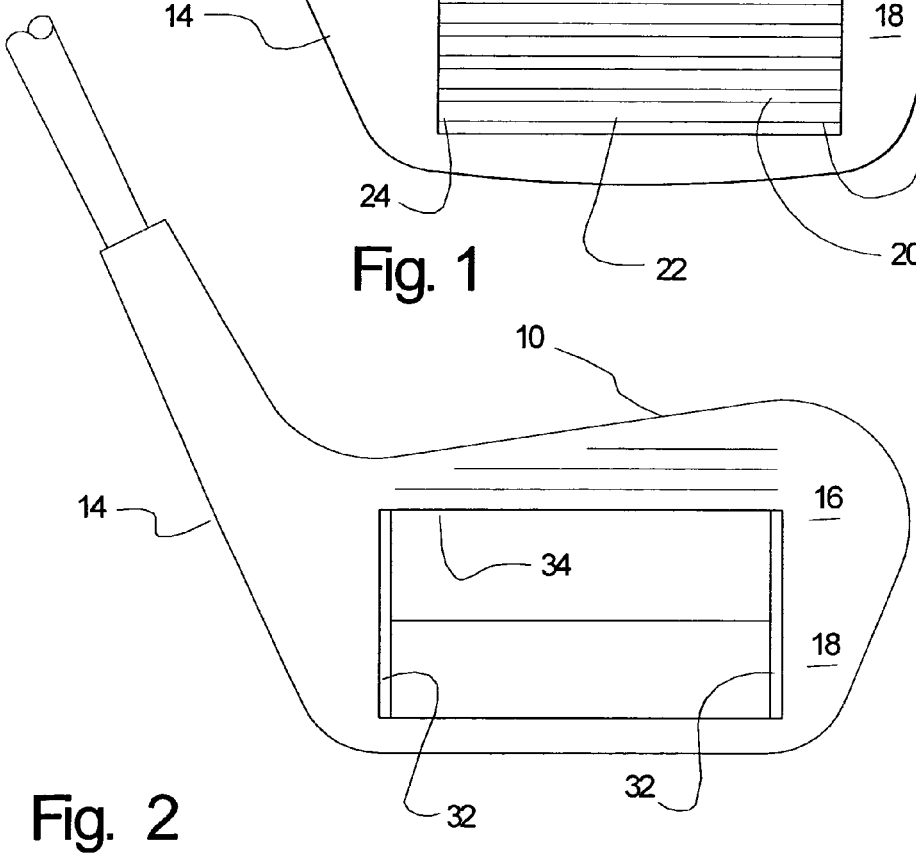
FIG. 2 is a view looking at a club with an aperture that can accepts the spring members as part of an insert.
Figure 3:
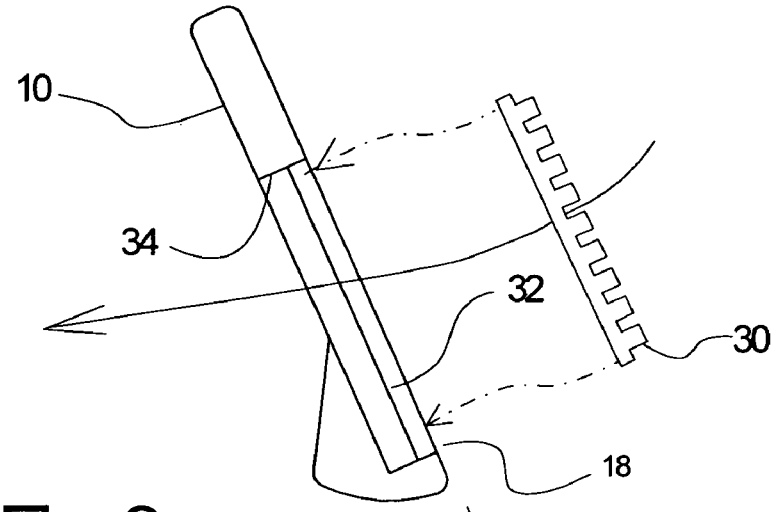
FIG. 3 is a sectional view through a club head that has supports for accepting an insert with the spring members.

Turning now to FIG. 1 where a golf club head 10 that is mountable on a golf club shaft 12 has been illustrated including an example of the disclosed invention. The example of the golf club head 10 has been shown including a body 14, having a face 16 with a planar surface 18. The face 16 of the club will have several slotted apertures 20 that extend through the body 14 of the club head 10. The slotted apertures 20 may "extend through" by providing access to a larger aperture that in-turn creates a passage through the club head 10. This arrangement would be particularly useful in the case of a wood. Additionally, the slotted apertures may "extend through" the club by simply defining an aperture of generally constant cross-sectional area all the way through the thickness of the club, as may be found in an "iron" type club.

According to one example of the invention, illustrated in FIGS. 1–4, the slotted apertures 20 have been defined by several generally parallel, spaced-apart elongated spring members 22. The elongated spring members 22 will preferably include ends 24 that are of a length 26. Additionally, the spring members 22 will be of a stiffness that will resist bending of the spring member 22, and most preferably, each of the spring members 22 will have a varying stiffness along its length. The variation of the bending stiffness may be accomplished by varying the cross-section 36 of the spring members 22 along the length of the spring members 22. It will be understood that varying the cross-section 36 is an example of how to vary the mechanical properties of the spring members 22 along the length 26 of the spring members 22. It is also contemplated that the mechanical properties of the spring members 22 may also be varied by changing filament arrangements in the case of spring members 22 that are made of composite materials, such as graphite composites or other composites, or by or by varying the shape of the cross-section, by varying the heat-treatment of the material along the length of the spring member, varying the type and amount of material used, and by other known ways.

The length 26 of each of the spring members 22 will be defined by the distance between the ends 24 of the spring members 22. The ends 24 of the spring members 22 will be supported from a pair of spaced-apart end supports 28, which may be part of the club head 10 or may be part of an insert 30 that may be attached onto the club head 10.

Figure 4:
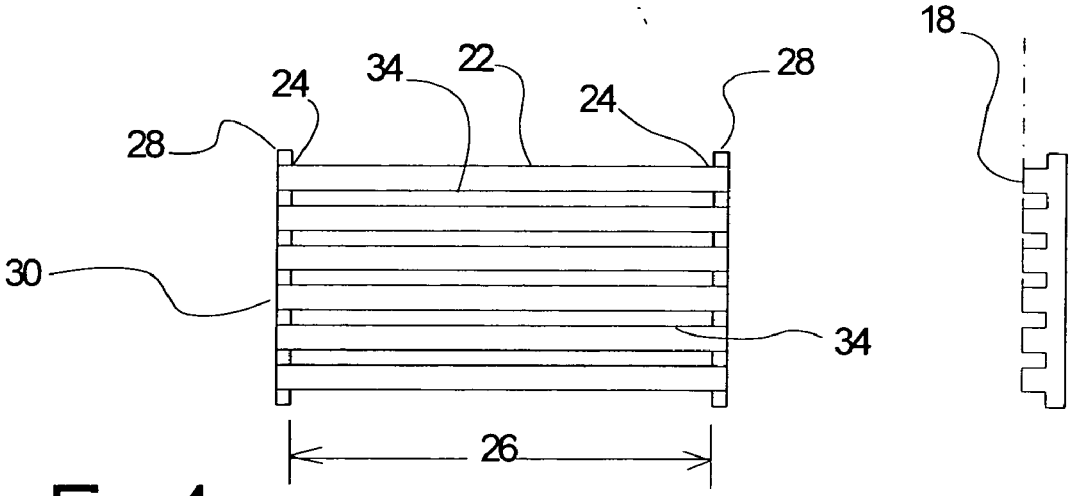
FIG. 4 illustrates an insert with various spring members.

An example of the insert 30 has been illustrated in FIG. 4. The example of the insert 30 shown on FIG. 4 includes spring members 22 that of unitary one-piece construction with the spaced-apart end supports 28, and has been adapted for mounting from a recess 32 in the club head 10 shown in FIG. 3. The recess 32 is along an aperture 34 in the club head 10. Thus, the slotted apertures 20 created with the spring members 22 will allow air to flow through the club head 10 as the club is swung, and then flow into the aperture 34 after flowing past the spring members 22. Furthermore, it is contemplated that the spring members 22 will be positioned on the club head 10 such that they remain flush or at substantially coplanar with the club face 16.

Thus, the varied stiffness of the individual elongated spring members 22 will produce a club face 16 that includes varying stiffness, or rigidity, along the club face 16. This varying stiffness allows the variation of the "sweet spot" of the club head 10.

Figure 5:
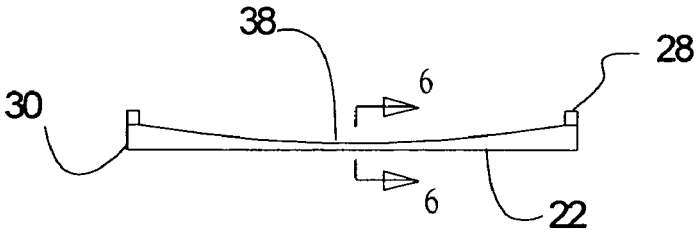
FIG. 5 is a side view of an insert and illustrates the tapering of the spring members to vary the stiffness of the spring members along the length of the spring member.
Figure 6:
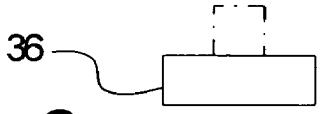
FIG. 6 illustrates a cross-section of a spring member.

Turning to FIG. 5, it will be understood that in an example of the invention, at least one of the spring members 22 has a mid-portion 38 with a lower stiffness or lower bending stiffness (rigidity). Thus, it is contemplated that the varied stiffness may consist of lowered stiffness at the mid-portion 38, or at another location along the spring member in order to tailor the sweet-spot on the club face 16.

Figure 7:
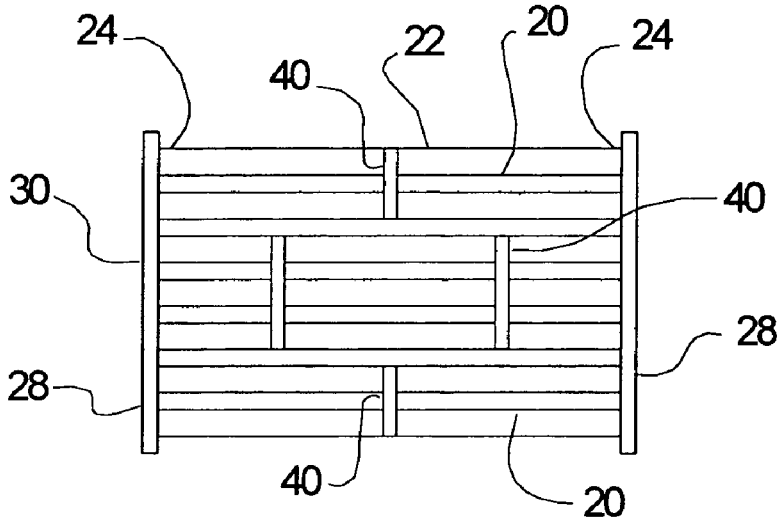
FIG. 7 is a view of the back of an insert, or club face with slotted apertures, and illustrates the use of bridging connectors to create an area of reduced stiffness on the club face.
Figure 8:
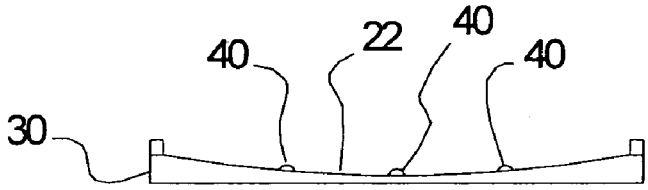
FIG. 8 is a side view of the embodiment illustrated in FIG. 7, and provides an example of the increased stiffening of the interconnected spring members.

Turning now to FIGS. 7–8, it will be understood that the golf club head 10 or the insert 30 may include several spring members 22 that are connected to one another at a location 40 between the ends 24 of each elongated spring member 22. The connection or selective connection of spring members 22 to one another will allow additional tailoring of the stiffness of the overall assembly, and hence tailor the sweet spot and the effect on the ball that is imparted by the club face 16 that incorporates the disclosed invention. For example, if it is desired to impart a back-spin on the ball, two of the lower spring members may be connected to one another, so that a stiffer assembly of spring members contact the lower portion of the ball, inducing a back-spin on the ball once it is struck. Of course, the stiffness arrangement may also be tailored by simply using spring members 22 of different stiffnesses.

It is important to note that while a highly preferred embodiment of the invention includes the gaps for allowing air flow through the club head 10, it is also contemplated that the principles of varying the stiffness of elongated spring members 22 may also be used to form a club that does not take advantage of the air flow, but uses multiple elongated spring members to form a tailored sweet spot on the club face.

Turning to FIGS. 7 and 8 it will be understood that it is contemplated that the disclosed system may incorporate the use of at least one bridging connector 40 that is used to mechanically connect at least two of the elongated spring members 22 to one another. It has been discovered that one can further tailor the stiffness of the club face 16 by mechanically connecting at least two of the spring members 22. Additionally, it has been discovered that one can modify or control the size of the sweet spot by selecting the location along the spring members 22 where to connect the bridging connectors 40 one can produce a dramatic increase or change in stiffness along the face 16 of the club. Thus by placing the bridging connectors 40 in a spaced apart relationship from one another one can create a large sweet spot that is centered or positioned at a desired position on the club face 16.

Figure 9:
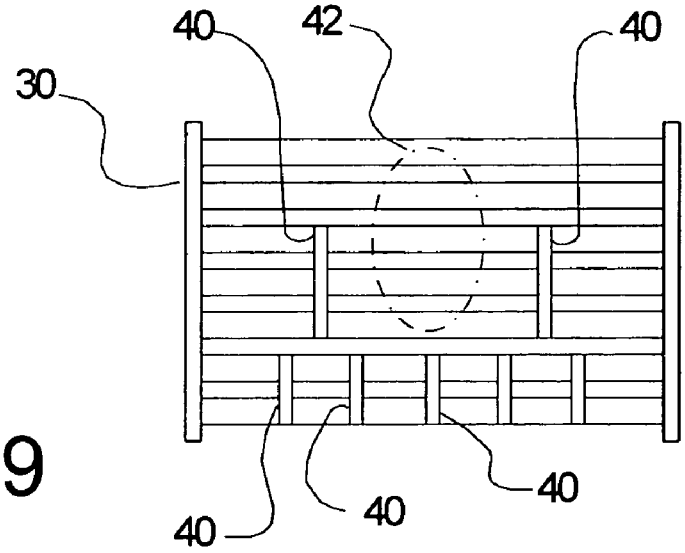
FIG. 9 illustrates the use of bridging connectors to create a desired effect on the ball by varying the stiffness in a vertical direction along the club face.

Still further, it will be understood that it is contemplated that the disclosed system may be used to create a club face that can impart desired dynamic effects on the golf ball once it is struck. For example, as shown in FIG. 9, by placing or connecting several elongated spring members 22 that are found near the lower edge of the club head 10, while leaving higher spring members 22 un-connected to one another (or with fewer connections), one can cause the club face 16 to impart a back-spin on the golf ball once the ball is struck.

Thus it can be appreciated that the above described embodiments are illustrative of just a few of the numerous variations of arrangements of the disclosed elements used to carry out the disclosed invention. Moreover, while the invention has been particularly shown, described and illustrated in detail with reference to preferred embodiments and modifications thereof, it should be understood that the foregoing and other modifications are exemplary only, and that equivalent changes in form and detail may be made without departing from the true spirit and scope of the invention as claimed, except as precluded by the prior art.

What is claimed is:

1. An insert for use with a golf club head, the golf club head having an aperture theretrough, the insert comprising at a pair of spaced-apart end supports that have been adapted for being supported from the aperture in the golf club head, the insert having a plurality of elongated spring members having ends that are of unitary one-piece construction with the spaced-apart end supports, each of the elongated spring members extending between the spaced-apart end supports uninterrupted by connections between the ends to adjacent spring members, each of the spring members having a varying stiffness along their length, the varying stiffness being larger at the ends than at between the ends, the variation in stiffness being produced by a progressive reduction in cross-section of the spring member between the ends, the progression commencing at the ends and progressing towards to about half way between the ends; and at least four elongated spring members and at least two, but not all, of said elongated spring members are connected to one another by at least one bridging connector connecting at least two of said elongated spring members to one another.

2. An insert according to claim 1 comprising at least two bridging connectors that are spaced apart from one another.

3. An insert according to claim 2 wherein said bridging connectors are attached to said elongated spring members such that the area of reduced stiffness of each of said elongated spring members is between said bridging members.

4. A method for reducing drag and creating a sweet spot on golf club head that is mountable on a golf club shaft, the method comprising:

providing a golf club head having a body having a face with a planar surface; and creating at least two generally parallel slotted apertures that extend through the body of the club head, the slotted apertures being defined by several generally parallel, spaced-apart elongated spring members, each elongated spring member having ends and being of a length, and incorporating into each of the spring members a varying stiffness along its length, the variation in stiffness being greater at a mid-portion of the spaced apart spring members, the spring members having a varying stiffness along their length, the varying stiffness being larger at the ends than at between the ends, the variation in stiffness being produced by a progressive reduction in cross-section of the spring member between the ends while maintaining the planar surface of the club face, the progression commencing at the ends and progressing towards to about half way between the ends; and said elongated members are supported from a pair of spaced-apart end supports, the pair of spaced-apart end supports being adapted for being mounted from said body.

5. A method according to claim 4 wherein said slotted apertures are formed from at least four elongated spring members at least two of said elongated members are connected to one another at a location between the ends of each elongated spring member.

* * * * *